US005765831A

United States Patent [19]

Huffhines

[11] Patent Number: 5,765,831

[45] Date of Patent: Jun. 16, 1998

[54] TETHERING SYSTEM FOR NOVELTY BALLOON

[76] Inventor: Terry W. Huffhines, 7862 Darnell, Lenexa, Kans. 66216

[21] Appl. No.: 620,036

[22] Filed: Mar. 21, 1996

[51] Int. Cl.[6] ..... A63H 27/10

[52] U.S. Cl. ..... 273/348.4; 273/DIG. 30; 446/225

[58] Field of Search ..... 273/346, 1.5 A, 273/416, DIG. 30, 348.4; 446/225, 220

[56] References Cited

U.S. PATENT DOCUMENTS

| | | | |
|---|---|---|---|
| 344,515 | 6/1886 | Biehl | 446/225 |
| 3,009,286 | 11/1961 | Warner | 446/267 X |
| 3,153,878 | 10/1964 | Smith, Jr. | 446/230 X |
| 3,250,241 | 5/1966 | Levy et al. | 446/220 X |
| 3,399,485 | 9/1968 | Cashavelly et al. | 446/15 |
| 3,591,975 | 7/1971 | Terc | 446/225 |
| 3,605,329 | 9/1971 | Dalli | 446/225 |
| 3,733,738 | 5/1973 | Kramer | 446/267 |
| 3,967,823 | 7/1976 | Yount | 273/346 |
| 3,968,784 | 7/1976 | Miller | 273/416 X |
| 4,038,777 | 8/1977 | Schwartz | 446/225 |
| 4,077,588 | 3/1978 | Hurst | 244/31 |
| 4,077,629 | 3/1978 | Chestney | 273/349 |
| 4,145,838 | 3/1979 | Mason | 446/225 X |
| 4,307,537 | 12/1981 | Bergmann | 446/222 |
| 4,356,661 | 11/1982 | Calderwood | 446/220 X |
| 4,533,145 | 8/1985 | Liebman | 273/378 |
| 4,573,938 | 3/1986 | Sassak | 446/179 |
| 4,891,029 | 1/1990 | Hutchinson | 446/58 |
| 4,946,415 | 8/1990 | Huang | 446/225 |
| 5,011,150 | 4/1991 | Averill | 273/DIG. 30 X |
| 5,031,908 | 7/1991 | Spector | 273/447 |
| 5,080,625 | 1/1992 | Huffhines | 446/225 |
| 5,184,827 | 2/1993 | Suttle et al. | 273/DIG. 30 X |

*Primary Examiner*—William H. Grieb
*Attorney, Agent, or Firm*—Litman, McMahon and Brown, L.L.C.

[57] ABSTRACT

A tethering system for a novelty balloon comprises a tether having a first portion of a contact type fastener secured thereto and a second portion of a contact type fastener secured to an outer surface of the balloon such that the tether is removably securable to the balloon by contacting the first portion of the contact type fastener on the tether to the second portion of contact type fastener on the balloon. In a preferred embodiment, the tethering system comprises a rod or post having a first portion of a hook and loop type fastener secured at one end and a base secured at an opposite end. A second portion of a hook and loop type fastener is secured to a surface of the balloon such that the tether may be secured to the balloon by pressing the end of the tether having the first portion of the hook and loop type fastener secured thereto against the second portion of hook and loop type fastener on the balloon.

4 Claims, 3 Drawing Sheets

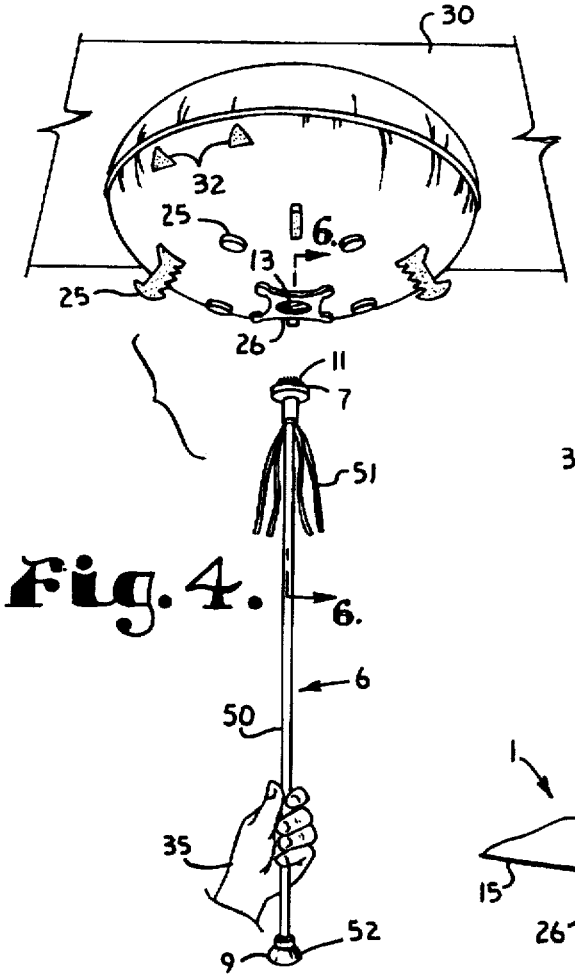
Fig. 4.
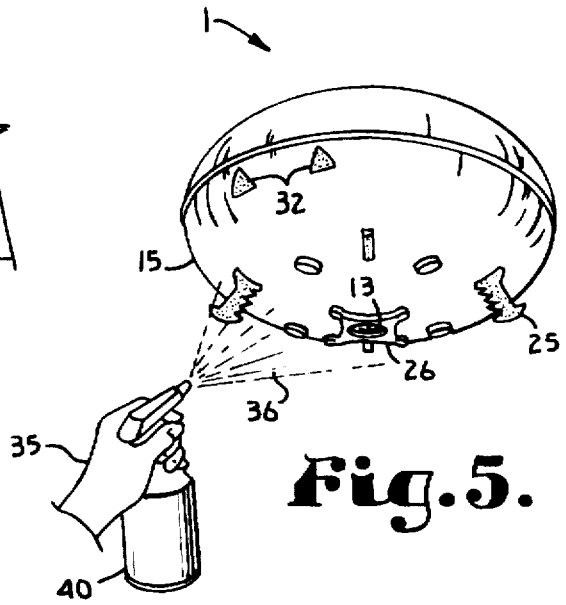
Fig. 5.
Fig. 6.
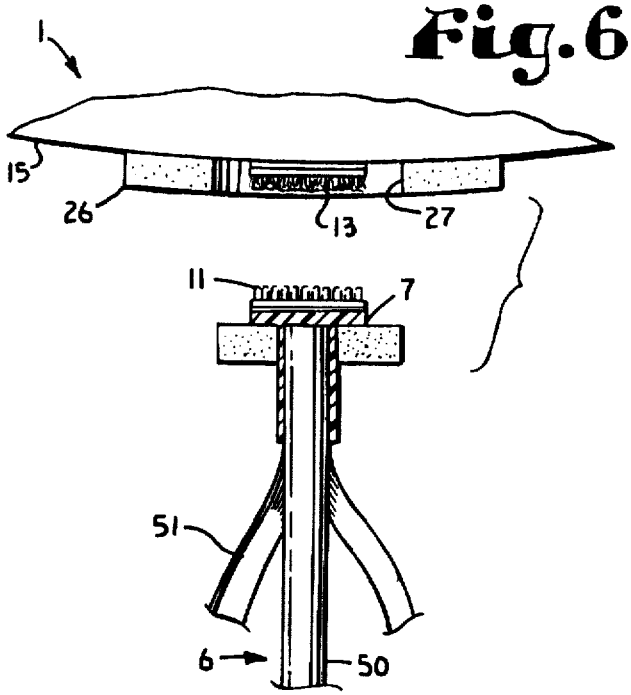
Fig. 7.
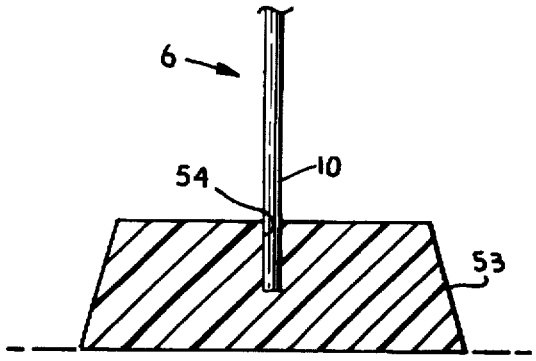

TETHERING SYSTEM FOR NOVELTY BALLOON

BACKGROUND OF THE INVENTION

The present invention relates to improvements to balloons and in particular an improved tethering system for a novelty balloon.

Balloons have always provided people with a certain amount of fascination and entertainment. An increasingly common sight is the helium-filled mylar balloons which carry congratulatory or motivational messages to young and old alike. Often however, such balloons provide nothing more than the initial surprise and thereafter continue to waft about in the air currents of their environment to the extent permitted by their tethering cords until the helium diffuses out of the balloon, causing the balloon and the associated fascination to deflate.

In my previous U.S. Pat. No. 5,080,625 for a BALLOON TARGET AND PISTOL (the '625 patent), I disclosed a free-floating balloon toy whose relative buoyancy was alterable by squirting the balloon surface or absorbent structures secured to the balloon surface with a stream of water. Initially, a sufficient amount of a volatile liquid, such as water, is added to one or more absorbent structures on the balloon, preferably on the top thereof, to decrease the buoyancy of the balloon such that it generally hovers. As the liquid evaporates, the buoyancy of the balloon increases and the balloon rises. Applying additional liquid to the surface of the balloon and in particular to the absorbent structure secured thereto then decreases the buoyancy of the balloon, causing the balloon to fall. The balloon then rises as the liquid evaporates providing an additional opportunity for a person to attempt to hit the balloon with a stream of water in the appropriate spots to cause the balloon to fall.

One limitation with the balloon target as disclosed in the '625 patent is the inadequacy of available tethering systems. The '625 patent did disclose incorporation of a tab on the balloon with a hole extending therethrough such that a cord could be tied to the tab to provide a tether to facilitate display and retrieval of the novelty balloon. However, having a cord secured to the balloon during use as noted above, impedes the ability of the balloon to hover freely during use and detracts from the free floating visual effect desired. Although tying a cord to the tab, as disclosed in the '625 patent, could be used to tether the balloon when not in use, having to untie the cord from the tab each time someone wants to use the balloon is inconvenient and sometimes difficult particularly if the knot is tied too tight. Further as the lighter-than-air gas in the balloon diffuses through the skin of the balloon over time the balloon tethered by a cord falls eliminating the desired visual effect of a floating balloon.

Further, if the balloon is released without a neutral buoyancy, the balloon will float to the ceiling, assuming the balloon was released indoors. If a tether is not secured to the balloon retrieval can be difficult. Although squirting water at the balloon could be used in an attempt to retrieve the balloon in such a situation, such a solution often will not be practical such as when the balloon is released in a room in which it is not desired to squirt a stream of water or if a water squirter is not available.

Therefore there is a need for an improved system for tethering and retrieving a novelty balloon such as a target type balloon.

SUMMARY OF THE INVENTION

The present invention comprises a tethering system for a novelty balloon. The tethering system comprises a tether having at least a portion of a contact type fastener secured thereto such that the tether is releasably securable to the balloon by the contact type fastener. In a preferred embodiment, the tethering system comprises a rod or post having a first portion of a hook and loop type fastener secured at one end and a base secured at an opposite end. A second portion of a hook and loop type fastener is secured to a surface of the balloon such that the tether may be secured to the balloon by pressing the end of the tether having the first portion of the hook and loop type fastener secured thereto against the second portion of hook and loop type fastener on the balloon.

The tethering system is particularly well adapted for use with a balloon target adapted to be filled with a lighter-than-air gas and having means for adjusting the aerial buoyancy of the filled balloon to a generally neutral aerial buoyancy to provide a free floating target and having means for remotely decreasing the aerial buoyancy of balloon. Such a balloon target is preferably constructed of a non-absorbent material which is substantially impervious to lighter-than-air gases such as helium. The balloon target includes an structural attachments constructed of lightweight material, at least a portion of which material is absorbent, and a buoyancy adjuster, which is also constructed of lightweight absorbent material. A remote buoyancy decreasing means, such as a water pistol or spray bottle, is provided to selectively decrease the buoyancy of the balloon target such as by the absorption of water sprayed on the target structural attachments thereby causing the balloon to sink or drop. Subsequent evaporation of water from the structural attachments increases the buoyancy of the balloon target causing it to rise providing a subsequent opportunity to attempt to hit the balloon target, and in particular the structural attachments of the balloon target with a stream of water.

The buoyancy decreasing means may also comprise a dart having a shaft or rod and a tip to which a first portion of a hook and loop type fastener is secured such that the dart may be propelled toward the balloon target in an attempt to cause the first portion of hook and loop type fastener on the tip to engage the second portion of hook and loop type fastener on the balloon to removably secure the dart to the balloon.

OBJECTS AND ADVANTAGES OF THE INVENTION

Therefore, it is an object of the present invention to provide an improved tethering system for a novelty balloon; to provide such a system which is particularly well adapted for use in tethering a balloon target; to provide such a system in which the tethering system includes a tether which is removably securable to a balloon; to provide such a system wherein the tether is securable to the balloon by touching or pressing one end of the tether to or against an outer surface of the balloon or at least bringing the end of the tether in close proximity to the balloon; to provide such a tethering system wherein the tether is securable to the balloon by a contact type fastener such as a hook and loop type fastener; to provide such a tethering system wherein a first portion of the hook an loop type fastener is secured to one end of the tether and a second portion of the hook and loop type fastener is secured to an outer surface of the balloon; to provide such a tethering system which facilitates retrieval of a balloon filled with lighter-than-air gas from a ceiling; to provide such a system adapted to secure the balloon to a structure; to provide such a system wherein the tether comprises a substantially rigid rod; to provide such a system having a base secured to a second end of the tether for supporting the tether to or on a surface; to provide such a tethering system adapted to support the novelty balloon in spaced relation above or away from the surface to which the tether is secured; to provide such a tethering system in which the tether may be ornamentally decorated; to provide such a tethering system in which the tether is relatively easily removed from said balloon; to provide such a tethering system in which the base comprises a contact type fastener; to provide such a tethering system which is relatively inexpensive to manufacture, easy to use and particularly well adapted for its intended uses thereof.

The drawings constitute a part of this specification and include exemplary embodiments of the present invention and illustrate various objects and features thereof.

BRIEF DESCRIPTION OF THE DRAWINGS

FIG. 4 is a reduced perspective view showing the tether being secured to the novelty balloon to retrieve the balloon from a ceiling.

FIG. 5 is a reduced perspective view of the novelty balloon without the tether secured thereto and showing the novelty balloon being sprayed with water.

FIG. 6 is an enlarged and fragmentary cross-sectional view taken along line 6—6 of FIG. 4.

FIG. 7 is an enlarged and fragmentary front plan view of the tether having a second or lower end secured within a weighted base which is shown in cross-section to show interior detail.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
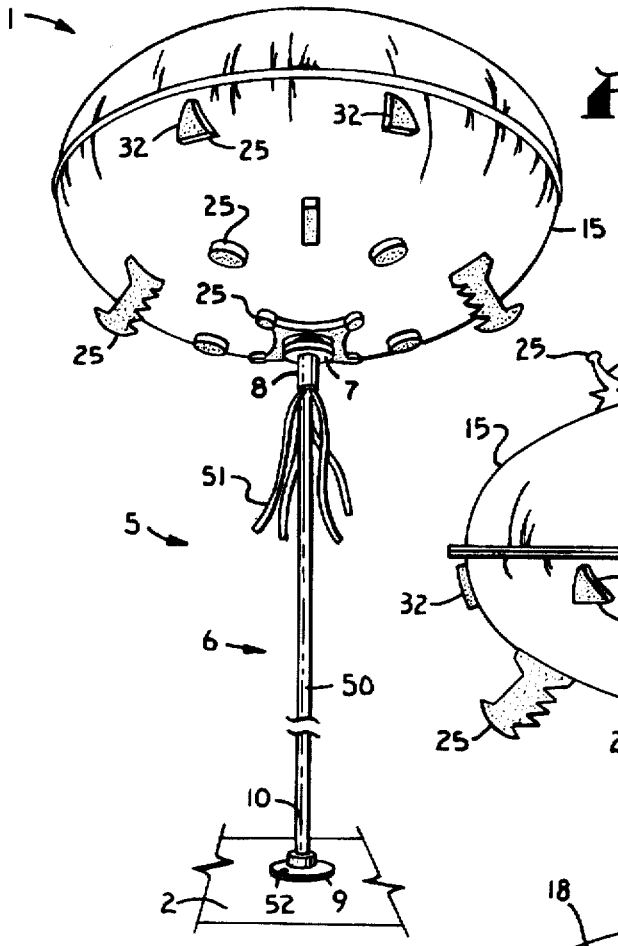
FIG. 1 is a perspective view of novelty balloon secured to a surface by a tether of the present invention.

Referring to the drawings in more detail and in particular FIG. 1, the reference numeral 1 generally refers to a novelty balloon which is secured to a surface 2 by a tethering system 5 of the present invention. The tethering system 5 generally comprises a tether 6 having a circular tip 7 secured at a first end 8 and a base 9 secured at a second end 10. As best seen in FIG. 6, a first portion 11 of a hook and loop type fastener, preferably comprising the hook portion, is secured to the tip 7. A second portion 13 of the hook and loop type fastener, preferably comprising the loop portion, is secured to an outer surface 15 of the balloon 1. The relative positioning of the hook and loop portions 11 and 13 of the hook and loop type fastener are interchangeable.

Figure 3:
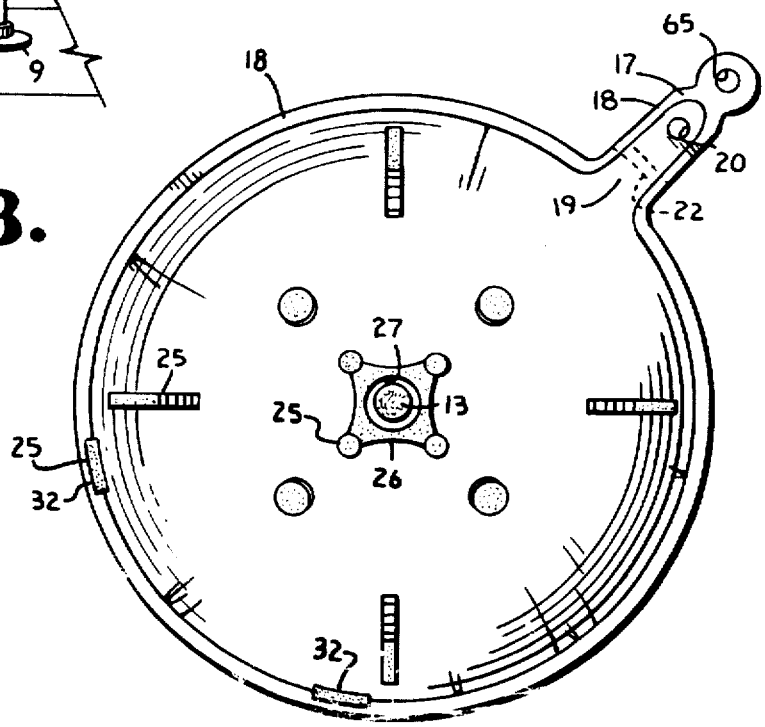
FIG. 3 is a bottom plan view of the novelty balloon shown removed from the tether.

The novelty balloon 1 is generally of the type disclosed in U.S. Pat. No. 5,080,625 and is adapted for use as a balloon target. The balloon 1 is constructed of a thin, lightweight, flexible, non-absorbent material or skin 16, such as a composite material comprising a layer of nonelastomeric polymer sheet having a continuous opaque coating of a vapor deposited metal on one side thereof as taught by U.S. Pat. No. 4,077,588. Two, generally circular sheets of the material or skin 16, each having a tab 17 extending from one side thereof are sealed together, with the tabs 17 aligned, along a peripheral edge 18 except along an inlet portion 19 thereof. A tube receiving hole 20 is formed in the tab 17 of one of the sheets of the skin 16. The hole 20 communicates with the area between the sheets of the skin 16 which defines an internal chamber 21 of the balloon 1. A layer of a resealable adhesive 22, shown in phantom lines in FIG. 3, is applied to inner surfaces of each sheet of the skin 16 across the tabs 17 between the tube receiving hole 20 and the internal chamber 21 of the balloon 1.

Figure 11:
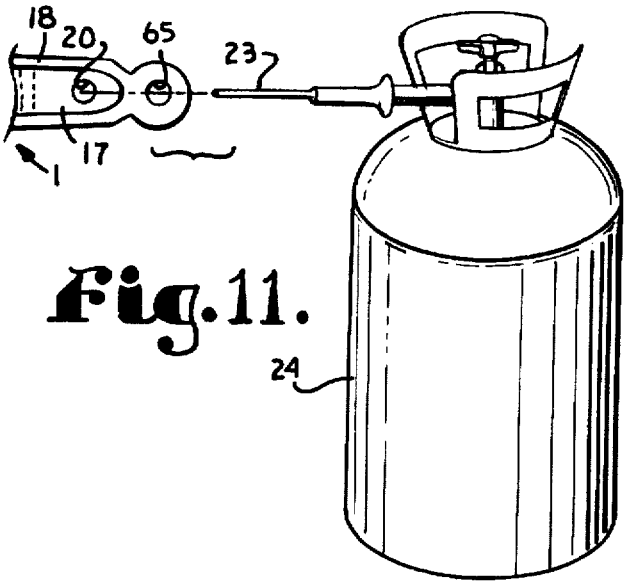
FIG. 11 is a perspective view of a pressurized canister with a supply tube secured thereto for use in filling the novelty balloon with a lighter-than-air gas.

The balloon 1 may be inflated by injection of a lighter-than-air gas into the balloon 1 through a supply tube 23, which is shown in FIG. 11, inserted through the tube receiving hole 20 and into the internal chamber 21. After the balloon 1 is inflated, the supply tube is removed and the sheets of skin 16 are pressed together at the tabs 17 such that the layer of adhesive 22 seals the two sheets together, closing off the internal chamber 21. A relatively small pressurized canister 24 of helium or other lighter-than-air gas, as shown in FIG. 11 and having the supply tube 23 connected thereto, may be packaged with, distributed with and/or sold together with the balloon 1 and the tether 6, as a kit, to permit the purchaser to refill the balloon 1 as needed.

Figure 2:
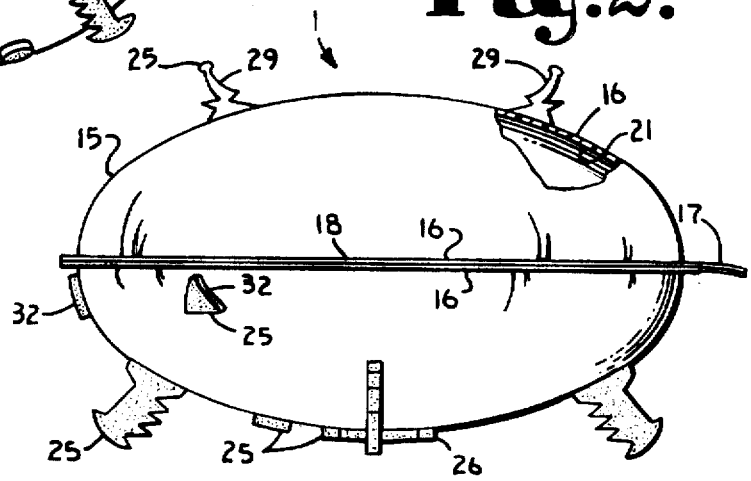
FIG. 2 is an enlarged front plan view of the novelty balloon shown removed from the tether and with portions broken away to show interior detail.

The balloon 1 is generally constructed such that, when inflated, it assumes a "flying saucer", or oblate spheroid shape as illustrated in FIG. 2. It is to be understood, however, that the tethering system 5 of the present invention is not dependent upon the balloon 1 assuming any particular shape nor is it dependent on the balloon 1 being constructed in any specific manner, of any specific materials or adapted for or being filled with a lighter-than-air gas. Various indicia (not shown) may be painted, printed, or otherwise provided on the outer surface 15 of the balloon 1 as desired.

A plurality of structural attachments 25, preferably formed of a lightweight absorbent material, such as foam rubber, are secured to the outer surface 20 of the balloon 1 by means such as gluing. The structural attachments 25 are generally spaced symmetrically about a vertical axis of the balloon 1 and are shaped and spaced to provide a desired appearance to the balloon 1 such as the appearance of a flying saucer as shown in FIGS. 1–5. It is foreseen that a wide range of appearances could be achieved with changes in the shape of the balloon 1 and the attachments 25, including the appearance of animal heads or bodies, human faces or machines such as airplanes.

One of the structural attachments 25, in the embodiment as shown in FIG. 3, is referred to as a cupola 26 and generally encircles the axis extending through the bottom of the balloon 1. An opening 27 is formed in a central portion of the copula 26. The second portion of hook and loop type fastener 13 is secured to the balloon 1 in the opening 27 such that the second portion 13 is generally positioned across the vertical axis of the balloon 1 on the bottom of the balloon 1. It is foreseen that the second portion 13 could be positioned anywhere on the outer surface 15 of the balloon 1, preferably the bottom portion thereof, and that any number of second portions 13 could be used.

One or more structural attachments 25, generally referred to as spacing attachments 29 may be secured to an upper portion of the balloon 1 for decorative purposes and to function as spacing means to generally keep the balloon 1 spaced slightly below a ceiling 30, shown in FIG. 4, or other structure if the balloon 1 is allowed to rise to the ceiling 30. Structure in the ceiling 30 or other surfaces with which the upper portion of the balloon 1 could come into contact, including vents, light fixtures and sprinkler heads, might contain sharp edges or projections which could puncture the thin skin 16 of the balloon 1. Placement of structural attachments 25 on an upper portion of the balloon as spacing means reduces the likelihood of the balloon 1 being punctured by such structure.

One or more structural attachments 25, generally referred to as counter balancing attachments 32, may be secured to a side of the balloon 1 generally opposite the tabs 17. A sufficient amount of water may be applied to the attachments 32 for absorption thereby to counterbalance the weight of the tabs 17 to ensure a level orientation of the balloon 1.

The copula 26 is particularly well adapted for use in adjusting the buoyancy of the balloon 1 to a neutral or slightly positive buoyancy by applying a sufficient amount of water or other suitable volatile liquid to the copula 26 to increase the weight of the balloon 1 to the amount necessary to decrease the buoyancy of the balloon 1 to neutral or slightly positive and to cause the balloon 1 to generally hover or rise slowly. Used in such a manner, the copula 26 generally functions as buoyancy adjustment means for adjusting the aerial buoyancy of the filled balloon 1 to a generally neutral or slightly positive aerial buoyancy. It is foreseen that any of the structural attachments 25 could be used by the application of a volatile liquid thereto to function as buoyancy adjustment means. However, the copula 26 is the preferred buoyancy adjustment means because it is positioned centrally around the vertical axis of the balloon 1 on the underside thereof such that use of the copula 26 as the buoyancy adjustment means provides for a more stable or level orientation of the balloon 1.

Once the buoyancy of the balloon 1 is adjusted to a neutral or slightly positive buoyancy as discussed, the balloon 1 is released to hover or slowly rise in an enclosed room or space. As the water or other volatile liquid applied to the structural attachments 25 evaporates, the balloon 1 begins to rise or the rate at which the balloon 1 rises increases.

As generally shown in FIG. 5, a user 35 then directs a stream or spray of water, or other volatile liquid, 36 toward the structural attachments 25 in an effort to cause additional water to adhere to and be absorbed by the structural attachments 25. Absorption of additional water by the structural attachments 25 or adherence of water thereto, increases the weight of the balloon 1, decreasing the buoyancy of the balloon 1 and causing the balloon to drift downward or fall or at least decreasing the rate at which the balloon 1 rises. Adherence of water to the outer surface 15 of the balloon 1 has the same effect but generally to a lesser degree. Subsequent evaporation of the water results in increased buoyancy of the balloon 1 such that the balloon again begins to rise, providing subsequent opportunities for the user 35 to test his or her marksmanship and attempt to hit the balloon 1 with a stream or spray of water 36.

The stream or spray of water 36 is provided from a liquid ejector 40 which is constructed such that the user 35 can selectively and arbitrarily cause a volatile liquid contained in an internal chamber (not shown) of the ejector 40 to be discharged therefrom. The ejector 40 may take many forms including a spray bottle as shown in FIG. 5 or a water pistol as shown in U.S. Pat. No. 5,080,625. It is preferable that the ejector 40 incorporate means for adjusting the character of the liquid stream or spray discharged therefrom, between a well defined stream and a relatively fine spray or mist as is well known in the spray bottle art. Use of a well defined stream provides a greater challenge in hitting the structural attachments 25 and causing water to be absorbed by or adhere to the structural attachment 25 whereas a fine mist or spray of water is more readily absorbed by the structural attachments 25 or more readily adheres to the structural attachments 25 and the outer surface 15 of the balloon 1.

Referring to the tethering system 5 in more detail, the tether 6 of the embodiment as shown in FIGS. 1, 4 and 6 comprises a rod or post 50 having ribbon 51 secured thereto for decorative purposes. It is foreseen that the rod 50 could be formed from a wide variety of materials including wood, metals, plastic, fiberglass or composite materials. The rod 50 is preferably substantially rigid in that it is substantially incompressible but may be flexible from side to side such as with a rod formed from semi-flexible plastic tubing or fiberglass.

The tether 6 is secured to the balloon 1 by pressing the first portion 11 of the hook and loop type fastener on the tip 7 of the tether 6 against the second portion 13 of the hook and loop type fastener on the balloon 1. The tether 6, is particularly well adapted for supporting and displaying the novelty balloon 1 in spaced relation above a surface 2, as shown in FIG. 1, and for retrieving the balloon 1 from a ceiling 30, as shown in FIG. 4. In certain circumstances it may not be desirable to try to use the liquid ejector 40 to try to retrieve a balloon 1 which has drifted to the ceiling 30 such as if the balloon is in a formal room or the ejector 40 is not available. The tether 6 can be used to facilitate retrieval of the balloon in such circumstances by generally providing a rigid extension of the arm permitting pressing of the first portion 11 of the hook and loop type fastener against the second portion 13 to releasably secure the balloon 1 to the tether 6.

It is foreseen that the rod 50 could be telescoping and include locking means for selectively securing the telescoping rod in an extended alignment such that the rod in the extended alignment was substantially rigid. It is also foreseen that the tether 6 could take the form of a substantially rigid structure. For example, the tether 6 could be formed or shaped to resemble a landing dock or tethering station for a space craft.

The first and second portions 11 and 13 of the hook and loop type fasteners generally comprise a contact type fastener. It is foreseen that a wide variety of contact type fasteners could be used with the tethering system 5. For example a magnet could be attached to the end of the tip 7 of the tether 6 as a first portion of the contact type fastener and a thin ferrous metal disk could be attached to the outer surface 15 of the balloon 1 such that advancing the tip 7 into close proximity to or into contact with the metal disk causes the disk to magnetically couple with the magnet thereby releasably securing the balloon 1 to the tether 6. Further, the tip 7 of the tether 6 could be coated with a tacky, non-setting, releasable adhesive for releasably securing the tether 6 to the balloon 1.

The base 9 of the rod 50 comprises a suction cup 52 which may also be referred to as a contact type fastener. FIG. 7 shows an alternative embodiment of a weighted base 53 having a bore 54 extending at least partially therethrough into which the second end 10 of the tether 6 is removably positionable for supporting the tether 6 in an upright alignment.

Figure 8:
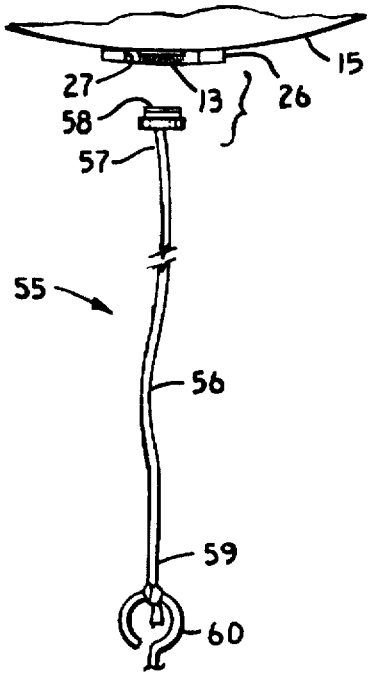
FIG. 8 is a reduced view similar to FIG. 6 showing an alternative embodiment of the tether.
Figure 10:
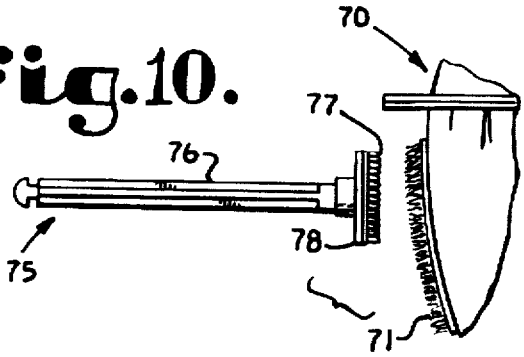
FIG. 10 is an enlarged and fragmentary view of the embodiment shown in FIG. 9 showing a dart secured to the novelty balloon.

FIG. 8 shows an alternative embodiment of a tether 55 which comprises a flexible cord, ribbon or string 56. A first end 57 of the tether 55 has a first portion 58 of a hook and loop type fastener, preferably the hook portion, secured thereto. A second end 59 of the tether 55 is securable to structure 60 by tying or the like. The string type tether 55 may be utilized in situations where it is desirable to have a lightweight and flexible tether secured to the balloon 1 or if it is preferable to be able to tie the tether 55 to a specific structure.

As shown in FIG. 3, a tethering hole 65 is formed in and through the aligned tabs 17 of the layers of thin skin 16 forming the balloon 1. A string (not shown) may be tied to the tabs 17 through the tethering hole 65 if it is desired to have a tether more securely attached to the balloon 1 than through use of a contact type fastener. For instance, it might be desirable to have a tether more securely attached to the balloon 1 when it is necessary to transport the balloon 1 outside.

Figure 9:
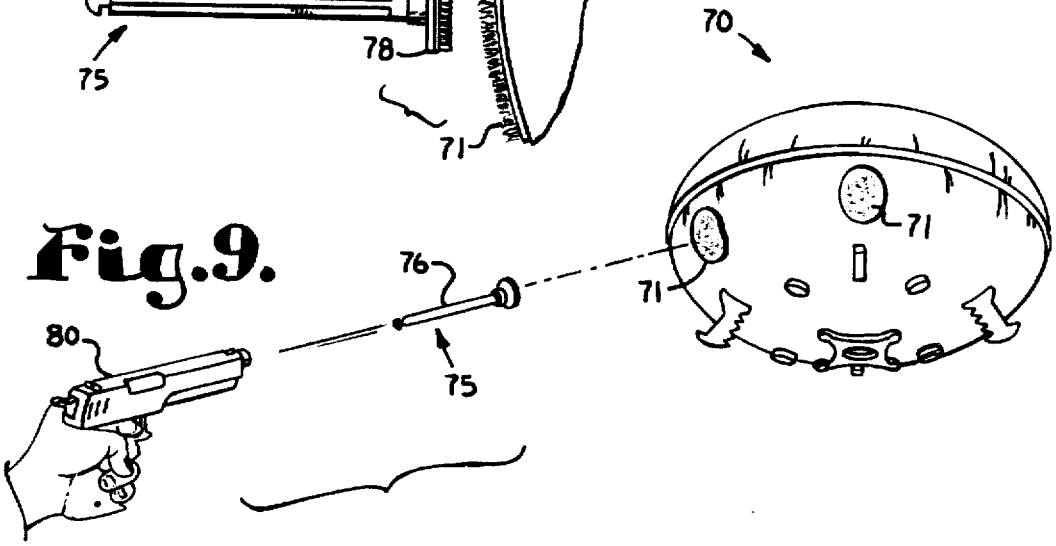
FIG. 9 is a perspective view showing an alternative embodiment of the novelty balloon adapted for use with a dart gun and dart.

FIG. 9 shows an alternative embodiment of a novelty balloon 70, similar to the novelty balloon 1 discussed above, but further including a plurality of second portions 71 of a hook and loop type fastener, preferably the loop portions, secured thereto. A dart 75 comprising a rod or shaft 76 having a first portion 77 of the hook and loop type fastener, preferably the hook portion, secured to a tip 78 thereof may be launched or propelled toward the balloon in an attempt to cause the first portion 77 on the dart 75 to come in contact with one of the second portions 71 on the balloon 70 to secure the dart 75 thereto. Securement of a dart 75 to the balloon generally changes the buoyancy of the balloon 70 to negative causing it to fall until the dart 75 is removed and the balloon 70 is allowed to rise or hover at slightly positive or neutral buoyancy respectively. The dart 75 may be propelled by propelling means such a spring loaded dart gun 80 as shown in FIG. 9. It is foreseen that other propelling means could be utilized including a bow or manual propulsion.

It is foreseen that any combination of the components discussed above could be packaged together, distributed together and/or sold together as a kit including balloons 1 and 70, tethers 6 and 55, liquid ejector 40, darts 75, dart gun 80, pressurized canister 24 and supply tube 23.

It is to be understood that while certain forms of the present invention have been illustrated and described herein, it is not to be limited to the specific forms or arrangement of parts described and shown.

What is claimed and desired to be secured by Letters Patent is as follows:

1. A novelty comprising:

a) a balloon having a first portion of a hook and loop type fastener secured to an outer surface of said balloon;

b) a substantially rigid tether having a second portion of a hook and loop type fastener secured to a first end thereof for releasably securing said first end of said tether to said balloon; and c) a support base secured to a second end of said tether for supporting said tether in a free-standing manner.

2. The novelty as in claim 1 wherein:

a) said balloon is adapted to be filled with a lighter-than-air gas.

3. The novelty as in claim 1 wherein:

a) said support base comprises a suction cup.

4. The novelty as in claim 1 wherein:

a) said tether comprises a rod.

* * * * *